United States Patent [19]

Tawara et al.

[11] Patent Number: 4,497,672

[45] Date of Patent: Feb. 5, 1985

[54] METHOD FOR THE PREPARATION OF A RARE EARTH-COBALT BASED PERMANENT MAGNET

[75] Inventors: Yoshio Tawara; Ken Ohashi, both of Fukui, Japan

[73] Assignee: Shin-Etsu Chemical Co., Ltd., Tokyo, Japan

[21] Appl. No.: 481,822

[22] Filed: Apr. 4, 1983

[30] Foreign Application Priority Data

Apr. 6, 1982 [JP] Japan ..... 57-57027

[51] Int. Cl.[3] ..... H01F 1/02

[52] U.S. Cl. ..... 148/102; 148/103; 148/104

[58] Field of Search ..... 148/101, 102, 103, 104, 148/31.57; 420/435, 582; 75/228, 230

[56] References Cited

U.S. PATENT DOCUMENTS

| | | | |
|---|---|---|---|
| 3,998,669 | 12/1976 | Strnat | 148/31.57 |
| 4,210,471 | 7/1980 | Yoneyama et al. | 148/102 |
| 4,276,097 | 6/1981 | Bergner et al. | 148/101 |

FOREIGN PATENT DOCUMENTS

| | | | |
|---|---|---|---|
| 55-62706 | 5/1980 | Japan | 148/104 |
| 56-156735 | 12/1981 | Japan | 148/31.57 |
| 57-100705 | 6/1982 | Japan | 148/31.57 |

*Primary Examiner*—John P. Sheehan

*Attorney, Agent, or Firm*—Hopgood, Calimafde, Kalil, Blaustein & Judlowe

[57] ABSTRACT

The permanet magnet composed of a rare earth element, e.g. samarium, and cobalt together with iron, copper and some other additive elements and prepared according to the inventive method has a high coercive force and excellent squareness of the magnetic hysteresis loop despite the relatively low content of copper which has been considered to be indispensable for obtaining a high coercive force. The characteristic feature of the inventive method consists in the aging treatment of the sintered body of the alloy powder of a specified composition undertaken in two or more steps, each being carried out by continuously cooling the sintered body within a specified temperature range at a specified cooling velocity.

5 Claims, No Drawings

METHOD FOR THE PREPARATION OF A RARE EARTH-COBALT BASED PERMANENT MAGNET

BACKGROUND OF THE INVENTION

The present invention relates to method for the preparation of a rare earth-cobalt based permanent magnet or, more particularly, to an improved method for the preparation of a rare earth-cobalt based permanent magnet with a relatively low content of copper as an additive element yet having a high coercive force and good squareness of the hysteresis loop.

As is well known, conventional rare earth-cobalt based permanent magnets are usually prepared with admixture of additional alloying elements of copper and iron in amounts of, for example, from 10 to 20% by weight and 5% by weight or larger, respectively, in consideration of the improvements obtained by the addition of copper to increase the coercive force and of iron to increase the residual magnetization of the magnets.

From the standpoint of the compatibility of these two magnetic parameters of a magnet, the addition of copper in a large amount is rather disadvantageous for the increase of the residual magnetization so that it would be very advantageous for rare earth-cobalt based permanent magnets if a high coercive force could be obtained even by the addition of a relatively small amount of copper, for example, less than 10% by weight.

It has been, however, a generally accepted conclusion that a sufficiently high coercive force can hardly be obtained with a rare earth-cobalt based permanent magnet of the alloying composition in which the content of copper as an additive element is low enough not to exceed 10% by weight or, in particular, not to exceed 8% by weight. There have been, of course, several attempts to overcome this difficulty. For example, certain improvement can be obtained in the coercive force of the magnet by a very much prolonged heat treatment or aging. Alternatively, the coercive force of a rare earth-cobalt based permanent magnet can be improved to some extent by the addition of certain alloying elements including zirconium, titanium, manganese, hafnium, tantalum and the like to the alloy composition for the powder metallurgical preparation of the magnet followed by heat treatment involving multi-step aging or continuous cooling-down. The highest coercive force of the magnets obtained by these improved methods unfortunately cannot exceed 7 kOe with an unavoidable problem of poor squareness of the magnetic hysteresis loop as one of the important characteristics of permanent magnets so that the permanent magnet prepared by these methods is not satisfactory in respect of the general performance of the magnets.

SUMMARY OF THE INVENTION

It is therefore an object of the present invention to provide a means for the preparation of a rare earth-cobalt based permanent magnet having a very high coercive force and excellent squareness of the hysteresis loop despite the relatively low content of copper in the alloy composition.

The method of the present invention established as a result of the extensive investigations undertaken by the inventors utilizes a specific scheme of the heat treatment or aging treatment undertaken in two or more successive steps which is effective in improving the coercive force and the squareness of the hysteresis loop of the magnet.

Thus, the method of the present invention for the preparation of a rare earth-cobalt based permanent magnet having an improved coercive force and residual induction as well as excellent squareness of the hysteresis loop comprises the steps of:

(a) sintering a shaped body of an alloy powder composed of from 22 to 28% by weight of at least one rare earth element, from 10 to 30% by weight of iron, from 2 to 10% by weight of copper and from 0.1 to 5% by weight of at least one additive element selected from the group consisting of zirconium, titanium, manganese, tantalum, hafnium, chromium, silicon, tungsten and vanadium, the balance being cobalt, into a sintered body;

(b) subjecting the sintered body to a primary aging treatment by heating at a temperature in the range from 600° to 850° C. followed by a first continuous cooling of the sintered body down to a temperature in the range from 300° to 400° C. at a cooling velocity in the range from 0.5° to 3.0° C./minute; and (c) subjecting the sintered body after the step (b) to a secondary aging treatment by heating at a temperature in the range from 700° to 900° C. followed by a second continuous cooling of the sintered body down to a temperature in the range from 300° to 500° C. at a cooling velocity in the range from 0.1° to 5.0° C./minute.

If necessary, the sintered body after the secondary aging treatment may be subjected further to a tertiary and a quaternary aging treatment, the schedule of heating and cooling in each of these additional aging treatments being approximately the same as in the secondary aging treatment.

According to the above described inventive method, a coercive force of 10 kOe or higher can readily be obtained of the permanent magnet in addition to the excellent squareness of the hysteresis loop needless to say about the good residual induction as a consequence of the low content of copper in the alloy composition.

DETAILED DESCRIPTION OF THE PREFERRED EMBODIMENTS

As is understood from the above given description, the most characteristic feature of the inventive method is obtained by the specific scheme of the heat treatment since the step (a) for the preparation of the sintered body is rather conventional.

In the first place, a rare earth-cobalt based alloy is prepared by melting together the above described component elements in the specified proportion and the alloy is pulverized into a fine powder by a suitable pulverizing machine. The alloy powder is then molded by compression into a shaped body which is subjected to sintering under known conditions into a sintered body. Molding of the alloy powder filling a mold is usually performed in a magnetic field of at least 5000 Oe or, preferably, at least 7000 Oe by compression under a suitable pressure of, for example, 1000 kg/cm$^2$. The shaped body of the alloy powder is then sintered in an atmosphere of an inert gas or vacuum at a temperature in the range from about 1150° to 1250° C. for at least 1 hour.

Heat treatment or aging of the sintered body is undertaken conventionally in any of the prior art methods but the aging treatment in the inventive method is performed in two or more steps or performed at least twice. The first step of the aging treatment is performed by heating the sintered body at a temperature in the range from 600° to 850° C. followed by a first continuous cooling of the sintered body from the above mentioned temperature down to a temperature in the range from 300° to 400° C. at a cooling velocity in the range from 0.5° C. to 3.0° C./minute or, preferably, from 1.0 to 2.0° C./minute. On the other hand, the secondary aging treatment is performed by heating the sintered body after the primary aging treatment above at a temperature in the range from 700° to 900° C. followed by a second continuous cooling of the sintered body from the above mentioned temperature down to a temperature in the range from 300° to 500° C. at a cooling velocity in the range from 0.1° to 5.0° C./minute or, preferably, from 0.1° to 1.0° C./minute. It is preferable that the starting temperature in the second cooling is in the range between the same temperature as the starting temperature in the first cooling and a temperature higher by 150° C. than the starting temperature is in the first cooling.

It is noted that the continuous cooling of the sintered body in each of the primary and secondary aging treatments may be started immediately when the temperature of the sintered body has reached the specified starting temperature in the respective steps without keeping the sintered body at the temperature any longer. It is optional that the secondary aging treatment may directly succeed the primary aging treatment without any interpose. The rate of temperature increase from the lowermost temperature in the first cooling up to the starting temperature of the second continuous cooling is not particularly limitative but should preferably be not larger than 20° C./minute.

As mentioned before, the sintered body after the above described primary and secondary aging treatments may be subjected further to a tertiary and a quaternary aging treatment, if necessary. Such an additional aging treatment is effective in improving the uniformity of the coercive force of the magnets after the secondary aging treatment from piece to piece or in increasing the coercive force of the magnet. The schedule of heating and cooling in these tertiary and quaternary aging treatments may be approximately the same as in the secondary aging treatment. That is, the sintered body after the secondary aging treatment is again heated at a temperature in the range from 700° to 900° C. and, without necessity of keeping it any longer at this temperature, continuously cooled down to a temperature in the range from 300° to 500° C. at a cooling velocity in the range from 0.1° to 5.0° C./minute.

Following is a description of the significance of the limitations in the weight proportion of the individual component elements in the alloy powder from which the rare earth-cobalt based permanent magnet is prepared.

The rare earth element, which is typically samarium or cerium, is taken in an amount from 22 to 28% by weight of the alloy composition. When the amount of the rare earth element is outside the above range, the coercive force of the resultant permanent magnet rapidly decreases with the increase or decrease of the amount of the rare earth element although the optimum amount thereof is largely dependent on the formulation of the other transition elements. The content of iron is limited in the range from 10 to 30% by weight because the permanent magnet prepared from an alloy containing 10% by weight or less of iron has a decreased saturation magnetization while a content of iron larger than 30% by weight results in a decreased coercive force of the magnet in addition to the decrease in the density of the sintered body. Further, the content of copper is limited in the range from 2 to 10% by weight because no sufficiently high coercive force of the magnet can be obtained with a content of copper smaller than 2% by weight while the saturation magnetization is decreased with a content of copper larger than 10% by weight. The amount of the auxiliary additive elements, i.e. zirconium, titanium, manganese, tantalum, hafnium, chromium, silicon, tungsten and vanadium, should be in the range from 0.1 to 5.0% by weight because the coercive force of the magnet cannot be significantly improved by the addition of these elements in an amount smaller than 0.1% by weight while an excessively large amount of these elements over 5.0% by weight is undesirable due to the decrease in the saturation magnetization.

Followng are the examples to illustrate the method of the present invention in further detail.

EXAMPLE 1

A mixture composed of 24.1% by weight of samarium metal, 53.4% by weight of cobalt, 13.9% by weight of iron, 6.3% by weight of copper and 2.3% by weight of zirconium was melted in a high-frequency induction furnace under an atmosphere of argon to form an alloy and the ingot of the alloy was crushed in a jaw crusher and then in a Brown mill followed by pulverization in a jet mill into a fine powder having an average particle diameter of 3 to 5 μm. A mold was filled with this powder of the magnetic alloy in a magnetic field of 10 to 20 kOe to align the particles and the powder was shaped by compression under a pressure of about 1000 kg/cm$^2$. Thus shaped body of the magnet alloy was then subjected to sintering at 1190° C. for 1 hour followed by quenching to give a sintered body which was further subjected to the heat treatment according to the schemes given below.

Scheme I: heating at 800° C. for 20 hours followed by quenching

Scheme II; heating at 800° C. and then cooling at a constant velocity of 0.5° C./minute from 800° C. to 400° C. followed by quenching Scheme III: a first cooling at a cooling velocity of 1° C./minute from 750° C. to 400° C. followed by quenching and then a second cooling at a cooling velocity of 0.5° C./minute from 800° C. to 400° C. followed by quenching.

Meanwhile, the cooling-down in the Scheme II or in the first and second steps of the Scheme III was started immediately when the temperature of the sintered body had reached the starting temperature of 800° C. or 750° C. without keeping it at the temperature.

Similarly, two similar magnet alloys but with somewhat modified formulation were prepared and processed into permanent magnets in the same manner as described above and the magnetic properties of these permanent magnets were determined to give the results shown in Table 1 below. The magnetic properties determined were the residual induction $B_r$ in kG, coercive force ${}_iH_c$ in kOe and maximum energy product $(BH)_{max}$ in MGOe and the value of the so-called squareness ratio $(BH)_{max}/(Br/2)^2$ was calculated as a measure of the squareness of the magnetic hysteresis loop.

TABLE 1

| Magnet No. | Composition, % by weight Sm | Co | Fe | Cu | Zr | Scheme of heat treatment | Magnetic properties $B_r$ kG | $_iH_c$, kOe | $(BH)_{max}$, MGOe | $(BH)_{max}/(B_r/2)^2$ |
|---|---|---|---|---|---|---|---|---|---|---|
| 1 | 24.1 | 53.4 | 13.9 | 6.3 | 2.3 | I | 10.9 | 23.4 | 22.5 | 0.76 |
| 2 | | | | | | II | 10.9 | 9.6 | 23.2 | 0.78 |
| 3 | | | | | | III | 10.9 | 18.0 | 28.1 | 0.95 |
| 4 | 25.3 | 54.3 | 14.1 | 4.0 | 2.3 | I | 11.4 | 1.2 | 6.5 | 0.20 |
| 5 | | | | | | II | 11.4 | 7.6 | 24.8 | 0.76 |
| 6 | | | | | | III | 11.4 | 14.5 | 31.2 | 0.96 |
| 7 | 24.9 | 56.4 | 14.0 | 2.4 | 2.3 | I | 12.3 | 0.2 | 0.8 | 0.02 |
| 8 | | | | | | II | 12.3 | 3.3 | 21.2 | 0.56 |
| 9 | | | | | | III | 12.3 | 8.7 | 34.5 | 0.91 |

EXAMPLE 2

A magnet alloy of the same composition as used in the preparation of the magnet No. 4 to No. 6 in Example 1 was processed into sintered bodies in the same manner as in Example 1 and each of the sintered bodies were subjected to the heat treatment in two steps with the starting temperature and final temperature as well as the cooling velocity in each of the first and second steps as shown in Table 2 below. Table 2 also includes the results of the measurements of the magnetic properties of the thus prepared permanent magnets. In some of the preparations, only the first step of the heat treatment was undertaken with omission of the second step for comparative purpose.

TABLE 2

| Magnet No. | Temperature (°C.) and cooling velocity in the first step From | To | °C./min. | second step From | To | °C./min. | Magnetic properties $B_r$ kG | $_iH_c$, kOe | $(BH)_{max}$, MGOe | $(BH)_{max}/(B_r/2)^2$ |
|---|---|---|---|---|---|---|---|---|---|---|
| 10 | 850 | 400 | 1.0 | 800 | 300 | 0.5 | 11.4 | 15.6 | 28.5 | 0.88 |
| 11 | 800 | 400 | 1.0 | 800 | 300 | 0.5 | 11.4 | 15.4 | 30.8 | 0.95 |
| 12 | 750 | 400 | 1.0 | 800 | 300 | 0.5 | 11.4 | 14.5 | 31.2 | 0.96 |
| 13 | 700 | 400 | 1.0 | 800 | 300 | 0.5 | 11.4 | 10.3 | 31.3 | 0.96 |
| 14 | 650 | 400 | 1.0 | 800 | 300 | 0.5 | 11.4 | 7.6 | 31.0 | 0.95 |
| 15 | 600 | 400 | 1.0 | 800 | 300 | 0.5 | 11.4 | 6.4 | 29.5 | 0.91 |
| 16 | 750 | 400 | 1.0 | 900 | 300 | 0.5 | 11.4 | 9.7 | 28.7 | 0.88 |
| 17 | 750 | 400 | 1.0 | 850 | 300 | 0.5 | 11.4 | 18.1 | 31.0 | 0.95 |
| 18 | 750 | 400 | 1.0 | 800 | 300 | 0.5 | 11.4 | 14.5 | 31.2 | 0.96 |
| 19 | 750 | 400 | 1.0 | 750 | 300 | 0.5 | 11.4 | 7.3 | 30.4 | 0.94 |
| 20 | 750 | 400 | 1.0 | 700 | 300 | 0.5 | 11.4 | 6.2 | 29.2 | 0.90 |
| 21* | 800 | 400 | 0.1 | | | | 11.4 | 10.5 | 24.6 | 0.76 |
| 22* | 800 | 400 | 0.3 | | | | 11.4 | 9.7 | 25.2 | 0.78 |
| 23* | 800 | 400 | 0.5 | | | | 11.4 | 7.6 | 24.8 | 0.76 |
| 24* | 800 | 400 | 1.0 | | | | 11.4 | 2.2 | 16.8 | 0.52 |
| 25 | 750 | 400 | 1.0 | 800 | 300 | 0.1 | 11.4 | 18.8 | 30.7 | 0.94 |
| 26 | 750 | 400 | 1.0 | 800 | 300 | 0.3 | 11.4 | 17.3 | 31.0 | 0.95 |
| 27 | 750 | 400 | 1.0 | 800 | 300 | 0.5 | 11.4 | 14.5 | 31.2 | 0.96 |
| 28 | 750 | 400 | 1.0 | 800 | 300 | 1.0 | 11.4 | 9.2 | 30.8 | 0.95 |
| 29* | 750 | 400 | 1.0 | 800 | 300 | 6.0 | 11.4 | 2.6 | 18.4 | 0.57 |

*Comparative example

EXAMPLE 3

The same magnet alloy is used in Example 2 was processed into sintered bodies in the same manner as in Example 1 by sintering the shaped body of the powder at 1180° C., 1185° C., 1190° C., 1195° C. or 1200° C. each for 1 hour followed by quenching. These sintered bodies were subjected to the primary to quaternary aging treatments each in a schedule indicated in Table 3 below. Table 3 also includes the results of the measurements of these permanent magnets for the coercive force $_iH_c$ and the squareness ratio $(BH)_{max}/(Br/2)^2$ after each of the secondary to quaternary aging treatments. In Table 3, the Experiment Nos. 30 to 34 correspond to the above mentioned different sintering temperatures of 1180°, 1185°, 1190°, 1195° and 1200° C., respectively.

TABLE 3

| Exp. No. | | Aging treatment Primary | Secondary | Tertiary | Quaternary |
|---|---|---|---|---|---|
| | Cooling (°C.) from | 700 | 800 | 800 | 800 |
| | to | 400 | 300 | 300 | 300 |
| | Cooling Velocity, °C./minute | 1.0 | 0.5 | 0.5 | 2.0 |
| 30 | iHc* | 1,800 | 11,300 | 12,000 | 12,000 |
| | squareness ratio | — | 0.93 | 0.94 | 0.95 |
| 31 | iHc* | 1.650 | 11,000 | 11,900 | 12,100 |
| | squareness ratio | — | 0.95 | 0.95 | 0.96 |
| 32 | iHc* | 1,500 | 10,300 | 11,500 | 12,000 |
| | squareness ratio | — | 0.94 | 0.95 | 0.96 |
| 33 | iHc* | 1,500 | 9,700 | 11,000 | 11,600 |
| | squareness ratio | — | 0.92 | 0.93 | 0.94 |
| 34 | iHc* | 1,300 | 8,800 | 10,300 | 10,800 |
| | squareness ratio | — | 0.89 | 0.91 | 0.93 |

*in oersted

What is claimed is:

1. A method for the preparation of a rare earth-cobalt based permanent magnet which comprises the steps of:

(a) sintering a shaped body of an alloy powder composed of from 22 to 28% by weight of at least one rare earth element, from 10 to 30% by weight of iron, form 2 to 10% by weight of copper and from 0.1 to 5% by weight of at least one additive element selected from the group consisting of zirconium, titanium, manganese, tantalum, hafnium, chromium, silicon, tungsten and vanadium, the balance being cobalt, into a sintered body;

(b) subjecting the sintered body to a primary aging treatment by heating at a temperature in the range from 600° to 850° C. followed by a first continuous cooling of the sintered body down to a temperature in the range from 300° to 400° C. at a cooling velocity in the range from 0.5° to 3.0° C./minute; and (c) subjecting the sintered body after the step (b) to a secondary aging treatment by heating at a temperature in the range from 700° to 900° C. followed by a second continuous cooling of the sintered body down to a temperature in the range from 300° to 500° C. at a cooling velocity in the range from 0.1 to 5.0° C./minute.

2. The method as claimed in claim 1 wherein the starting temperature of cooling-down in the step (c) is a temperature in the range between the same temperature as the starting temperature of the cooling-down in the step (b) and a temperature higher by 150° C. than the starting temperature of the cooling-down in the step (b).

3. The method as claimed in claim 1 wherein the velocity of temperature elevation from the lowermost temperature after the cooling-down in the step (b) to the starting temperature of the cooling-down in the step (c) does not exceed 20° C./minute.

4. The method as claimed in claim 1 wherein the sintered body after the step (c) is further subjected to a tertiary aging treatment by heating at a temperature in the range from 700° to 900° C. followed by a third continuous cooling down to a temperature in the range from 300° to 500° C. at a cooling velocity in the range from 0.1° to 5.0° C./minute.

5. The method as claimed in claim 4 wherein the sintered body after the tertiary aging treatment is further subjected to a quaternary aging treatment by heating at a temperature in the range from 700° to 900° C. followed by a fourth continuous cooling down to a temperature in the range from 300° to 500° C. at a cooling velocity in the range from 0.1° to 5.0° C./minute.

* * * * *